US008127739B2

(12) United States Patent
Kono et al.

(10) Patent No.: US 8,127,739 B2
(45) Date of Patent: Mar. 6, 2012

(54) VARIABLE STROKE ENGINE

(75) Inventors: Shohei Kono, Wako (JP); Sei Watanabe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 741 days.

(21) Appl. No.: 12/249,524

(22) Filed: Oct. 10, 2008

(65) Prior Publication Data

US 2009/0095262 A1 Apr. 16, 2009

(30) Foreign Application Priority Data

Oct. 11, 2007 (JP) ..... 2007-265674

(51) Int. Cl.
*F02B 75/32* (2006.01)

(52) U.S. Cl. ..... 123/197.1; 123/90.17; 123/48 R; 123/48 A

(58) Field of Classification Search ..... 123/90.17, 123/90.31, 48 B, 48 AA, 48 A, 48 R, 78 B, 123/78 BA, 197.1
See application file for complete search history.

(56) References Cited

U.S. PATENT DOCUMENTS

| | | | | |
|---|---|---|---|---|
| 2,314,789 | A | 3/1943 | Jacobsen | |
| 6,170,443 | B1 * | 1/2001 | Hofbauer | 123/51 B |
| 6,499,453 | B1 * | 12/2002 | Immel et al. | 123/90.31 |
| 6,622,670 | B2 * | 9/2003 | Hiyoshi et al. | 123/48 B |
| 6,820,586 | B2 * | 11/2004 | Watanabe | 123/197.1 |
| 6,857,401 | B1 * | 2/2005 | Styron | 123/48 B |
| 7,051,344 | B2 | 5/2006 | Mizuno | |
| 2002/0144665 | A1 * | 10/2002 | Ushijima et al. | 123/48 B |
| 2003/0230257 | A1 * | 12/2003 | Watanabe | 123/48 B |

FOREIGN PATENT DOCUMENTS

| | | | |
|---|---|---|---|
| CN | 1445445 | A | 10/2003 |
| CN | 1924318 | A | 3/2007 |
| EP | 1347159 | A2 | 9/2003 |
| JP | 2000-108704 | A | 4/2000 |
| JP | 2003-314237 | A | 11/2003 |
| JP | 2003-343297 | A | 12/2003 |

(Continued)

OTHER PUBLICATIONS

Chinese Office Action dated Oct. 12, 2010, issued in corresponding Chinese Patent Application 200810213108.3.
Japanese Office Action dated Jul. 20, 2011, issued in corresponding Japanese Patent Application No. 2007-265674.

(Continued)

*Primary Examiner* — Noah Kamen
*Assistant Examiner* — Long T Tran
(74) *Attorney, Agent, or Firm* — Westerman, Hattori, Daniels & Adrian, LLP; William F. Westerman

(57) ABSTRACT

A variable stroke engine has a crankshaft, a camshaft, and a rotational shaft, having an eccentric shaft, which are rotatably supported in a crankcase so as to have axes parallel to one another. A connecting rod is connected, at one end portion thereof, to a piston by a piston pin, and a control rod is connected, at one end portion thereof, to the eccentric shaft. The other end portion of the connecting rod and the other end portion of the control rod are linked to each other by a link member rotatably supported on the crankshaft. A rotative power of the crankshaft is transmitted to the camshaft and the rotational shaft, respectively. A timing driving wheel transmitting the rotative power to the camshaft side is mounted on the crankshaft, and a timing driven wheel driven by the timing driving wheel is mounted on the rotational shaft.

1 Claim, 3 Drawing Sheets

FOREIGN PATENT DOCUMENTS

| | | | |
|---|---|---|---|
| JP | 2005-54685 | A | 3/2005 |
| JP | 2005-211142 | A | 8/2005 |
| JP | 2006-250182 | A | 9/2006 |
| JP | 2007-64011 | A | 3/2007 |
| WO | 02/41313 | A1 | 5/2002 |

OTHER PUBLICATIONS

European Search Report dated Oct. 2, 2008, issued in corresponding European Patent Application No. EP 08016234.

* cited by examiner

VARIABLE STROKE ENGINE

TECHNICAL FIELD

The present invention relates to a variable stroke engine in which a crankshaft, a camshaft constituting a part of a valve-operating system, and a rotational shaft having an eccentric shaft, are rotatably supported in a crankcase of an engine body so as to have axes parallel to one another, a connecting rod is connected, at one end portion thereof, to a piston by a piston pin, a control rod is connected, at one end portion thereof, to the eccentric shaft, the other end portion of the connecting rod and the other end portion of the control rod are linked to each other by a link member rotatably supported on the crankshaft, and a rotative power of the crankshaft is transmitted to the camshaft and the rotational shaft, respectively.

BACKGROUND OF THE INVENTION

Such variable stroke engine has already been known as disclosed in Japanese Patent Application Laid-open No. 2005-54685 and the like.

However, in the variable stroke engine disclosed in Japanese Patent Application Laid-open No. 2005-54685, a driving gear for transmitting a power to a camshaft side and a driving gear for transmitting a power to a rotational shaft side are mounted on a crankshaft in a manner that these driving gears are adjacent to each other in the axial direction. Accordingly, the bearing span of the crankshaft is increased. This structure poses an increase in the diameter of the crankshaft for the purpose of avoiding deformation and an increase in friction of the crankshaft due to deterioration of the bearing support rigidity.

SUMMARY OF THE INVENTION

The present invention has been made in view of the above-described circumstance. It is an object of the present invention to provide a variable stroke engine having a reduced bearing span of a crankshaft, and thus being capable of preventing the bearing support rigidity from deteriorating while avoiding an increase in the diameter of the crankshaft.

In order to achieve the object, according to a first feature of the present invention, there is provided a variable stroke engine in which a crankshaft, a camshaft constituting a part of a valve-operating system, and a rotational shaft having an eccentric shaft, are rotatably supported in a crankcase of an engine body so as to have axes parallel to one another, a connecting rod is connected, at one end portion thereof, to a piston by a piston pin, a control rod is connected, at one end portion thereof, to the eccentric shaft, the other end portion of the connecting rod and the other end portion of the control rod are linked to each other by a link member rotatably supported on the crankshaft, and a rotative power of the crankshaft is transmitted to the camshaft and the rotational shaft, respectively, the variable stroke engine comprising: a timing driving wheel mounted on the crankshaft, and transmitting the rotative power to the camshaft, and a timing driven wheel mounted on the rotational shaft, and driven by the timing driving wheel.

With the first feature, the timing driving wheel is mounted on the crankshaft so as to be shared for the power transmission from the crankshaft to the camshaft and for the power transmission from the crankshaft to the rotational shaft. This configuration makes it possible to reduce the bearing span of the crankshaft as compared with a conventional variable stroke engine having two driving gears mounted on a crankshaft so as to be adjacent to each other. Accordingly, the bearing support rigidity can be prevented from deteriorating while an increase in the diameter of the crankshaft is avoided.

According to a second feature of the present invention, in addition to the first feature, the timing driving wheel is a gear, a driven gear meshing with the timing driving wheel is mounted on the camshaft, the timing driven wheel is a gear meshing with the timing driving wheel, and addendum modifications (an amount of difference between a reference circle and a reference line of a gear) of the timing driven wheel and the driven gear are set to be different from each other.

With the second feature, since the addendum modification of the driven gear mounted on the camshaft so as to mesh with the timing driving wheel, which is a gear, and the addendum modification of the timing driven gear, which is a gear meshing with the timing driving wheel, are set to be different from each other. This configuration makes it possible to reduce the engine in size while optimally distributing a load to be applied to the camshaft and the rotational shaft.

According to a third feature of the present invention, in addition to the first or second feature, the camshaft and the rotational shaft are disposed on the same side of a plane defined by the cylinder axis and the crankshaft axis.

With the third feature, as noted above, the camshaft and the rotational shaft are disposed on the same side of a plane defined by the cylinder axis and the crankshaft axis. This configuration makes it possible to make compact the entire engine by disposing the camshaft at a position close to the rotational shaft side while avoiding interference between the camshaft and the trajectory of motion of the link member.

Hereinafter, embodiments of the present invention will be described with reference to examples of the present invention which are shown in the accompanying drawings.

BRIEF DESCRIPTION OF THE DRAWINGS

FIG. 1 is a vertical cross-sectional side view of an engine, and is a cross-sectional view taken along a line 1-1 in FIG. 2.

FIG. 2 is a cross-sectional view taken along a line 2-2 in FIG. 1.

DETAILED DESCRIPTION OF THE INVENTION

Figure 1:
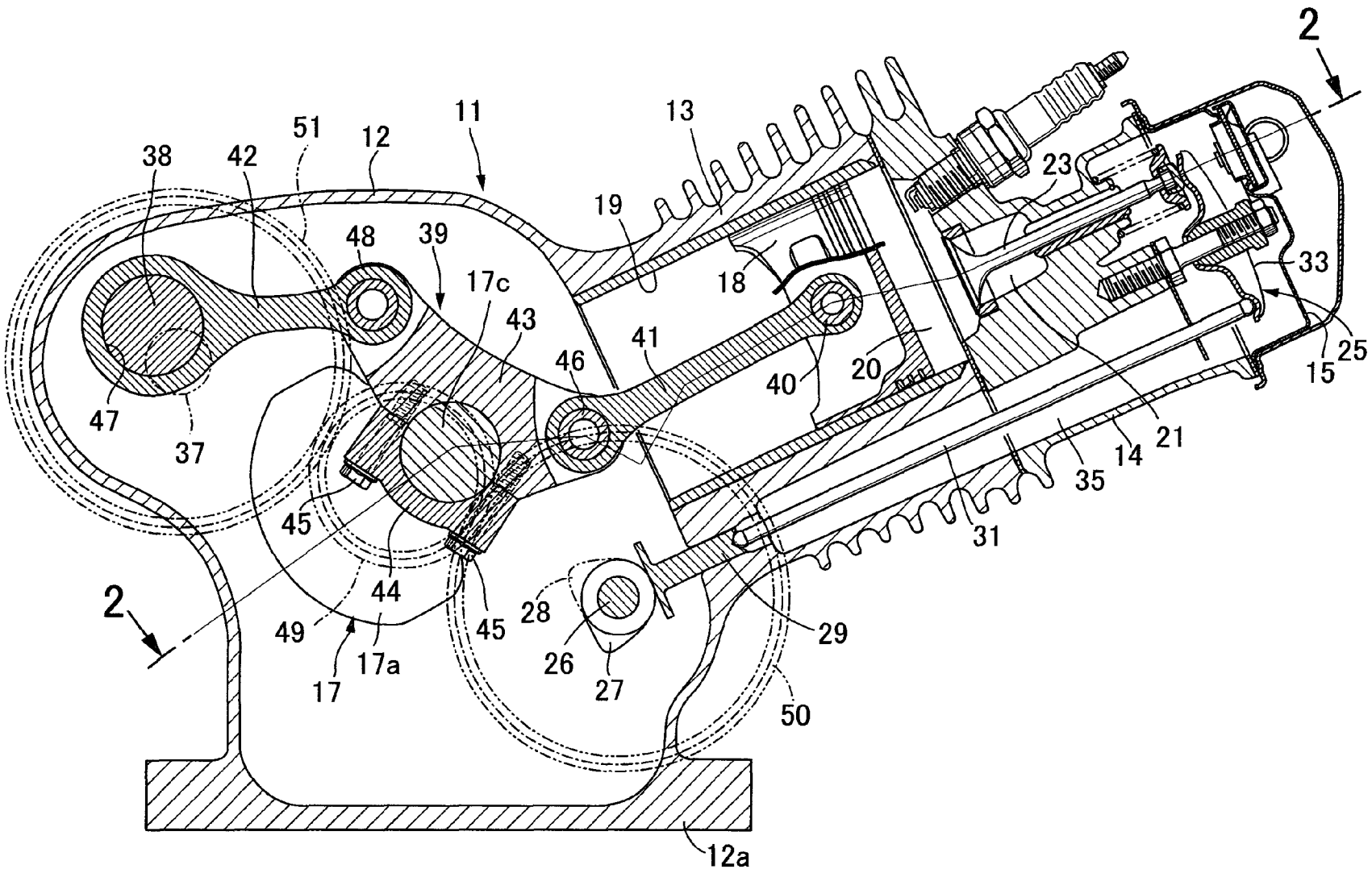
FIG. 1 and FIG. 2 show a first embodiment of the present invention.
Figure 2:
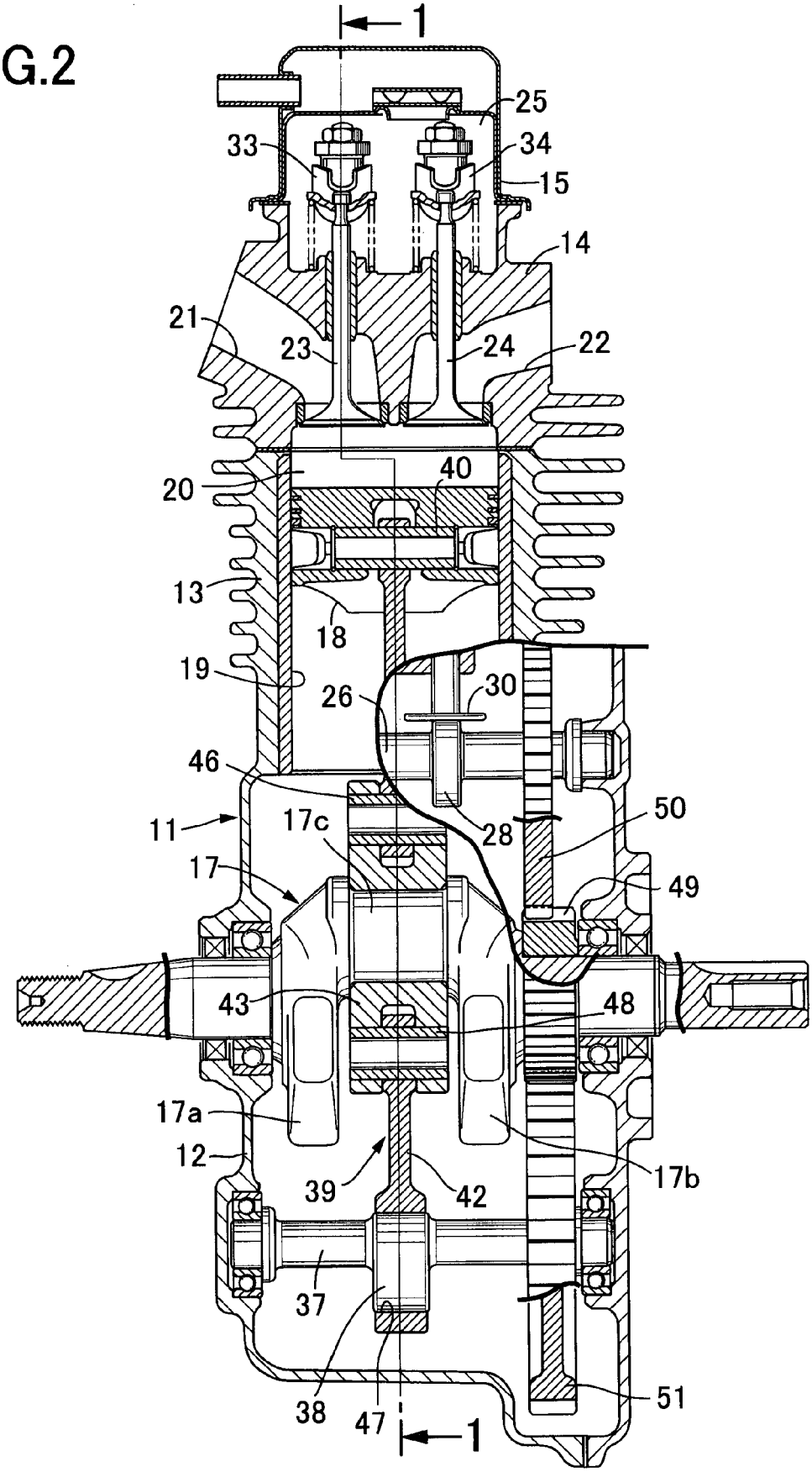

This engine is an air-cooled single cylinder engine, which is used for working machines and the like, for example. An engine body 11 includes: a crankcase 12; a cylinder block 13 protruding upward from the crankcase 12; a cylinder head 14 joined to a head portion of the cylinder block 13; and a head cover 15 connected to the cylinder head 14. The crankcase 12 is mounted on engine heads of various operating machines, at a mounting face 12*a* on the lower surface of the crankcase 12.

A crankshaft 17 is rotatably supported in the crankcase 12. The crankshaft 17 integrally has a pair of balance weights 17*a* and 17*b*, as well as a crank pin 17*c* which connects between the balance weights 17*a* and 17*b*.

A cylinder bore 19 is formed in the cylinder block 13. A piston 18 is slidably fitted in the cylinder bore 19. A combustion chamber 20 is formed between the cylinder block 13 and the cylinder head 14, and a top portion of the piston 18 faces the combustion chamber 20. An intake port 21 and an exhaust port 22, both communicating with the combustion chamber 20, are formed in the cylinder head 14. In addition, an intake valve 23 for opening and closing the passage between the intake port 21 and the combustion chamber 20 as well as an exhaust valve 24 for opening and closing the passage between the exhaust port 22 and the combustion chamber 20 are disposed in the cylinder head 14 so as to be capable of performing the opening and closing operations.

A valve-operating system 25 for driving the intake valve 23 and the exhaust valve 24 to be opened and closed includes a camshaft 26, an intake-side cam 27, an exhaust-side cam 28, an intake-side valve lifter 29, an exhaust-side valve lifter 30, an intake-side push rod 31, an exhaust-side push rod (not illustrated), an intake-side rocker arm 33, and an exhaust-side rocker arm 34. The camshaft 26 has an axis parallel to the crankshaft 17, and is rotatably supported in the crankcase 12. The intake-side and exhaust-side cams 27 and 28 are provided on the camshaft 26. The intake-side valve lifter 29 is operably supported in the cylinder block 13, and is in sliding contact with the intake-side cam 27. The exhaust-side valve lifter 30 is operably supported in the cylinder block 13, and is in sliding contact with the exhaust-side cam 28. The intake-side push rod 31 extends toward the head cover 15 while abutting, at the lower end thereof, on the intake-side valve lifter 29. The exhaust-side push rod extends toward the head cover 15 while abutting, at the lower end thereof, on the exhaust-side valve lifter 30. The intake-side rocker arm 33 is swingably supported in the cylinder head 14, while abutting, at one end thereof, on the intake valve 23 spring-biased in its closing direction. The upper end of the intake-side push rod 31 abuts on the other end of the intake-side rocker arm 33. The exhaust-side rocker arm 34 is swingably supported in the cylinder head 14, while abutting, at one end thereof, on the exhaust valve 24 spring-biased in its closing direction. The upper end of the exhaust-side push rod abuts on the other end of the exhaust-side rocker arm 34.

An operating chamber 35 is formed in the cylinder block 13 and the cylinder head 14. The upper portions respectively of the intake-side and exhaust-side valve lifters 29 and 30 protrude into the operating chamber 35 from the lower portion of the operating chamber 35. The intake-side push rod 31 and the exhaust-side push rod are disposed in the operating chamber 35.

A rotational shaft 37 having an eccentric shaft 38 is disposed on the opposite side of the axis of the crankshaft 17 from the camshaft 26. The rotational shaft 37 is rotatably supported in the crankcase 12 in a manner that the rotational shaft 37 is rotatable about its axis parallel to the crankshaft 17 and the camshaft 26.

A connecting rod 41 is connected, at one end portion thereof, to the piston 18 by a piston pin 40, while a control rod 42 is connected, at one end portion thereof, to the eccentric shaft 38. The other end portions respectively of the connecting rod 41 and the control rod 42 are linked to each other by a link member 43 which is rotatably supported by the crank pin 17*c* of the crankshaft 17. The connecting rod 41, the link member 43, and the control rod 42 constitute a link mechanism 39.

The link member 43 is formed to be in sliding contact with a half of the circumference of the crank pin 17*c*. A crank cap 44 is in sliding contact with the remaining half of the circumference of the crank pin 17*c*, and is fastened to the link member 43 with bolts 45, 45.

The connecting rod 41 is rotatably connected, at the other end portion thereof, to one end portion of the link member 43 by a first pin 46. A circular shaft hole 47 is formed in the one end portion of the control rod 42, and the eccentric shaft 38 is fitted in the circular shaft hole 47 so as to be relatively slidable. The control rod 42 is rotatably connected, at the other end portion thereof, to the other end portion of the link member 43 by a second pin 48.

The rotative power of the crankshaft 17 is transmitted to the camshaft 26 and the rotational shaft 37 while the rotational speed is reduced to a half. A driving gear 49 is mounted on the crankshaft 17, and arranged at a position to the outer side, in the axial direction, of the balance weight 17*b* of the crankshaft 17. The driving gear 49 serves as a timing driving wheel for transmitting the rotative power to the camshaft 26 side.

A first driven gear 50 meshing with the driving gear 49 is mounted on the camshaft 26. In addition, a second driven gear 51 meshing with the driving gear 49 and serving as a timing driven wheel is mounted on the rotational shaft 37. The first and second driven gears 50 and 51 are each formed to have an outside diameter which is twice as large as that of the driving gear 49. Moreover, while the width of the first driven gear 50 in the axial direction is set to be approximately half the width of the driving gear 49 in the axial direction, the width of the second driven gear 51 in the axial direction is set to be substantially the same as the width of the driving gear 49 in the axial direction, in consideration of the fact that the load between the crankshaft 17 and the rotational shaft 37 is larger than that between the crankshaft 17 and the camshaft 26.

Furthermore, addendum modifications respectively of the first driven gear 50 mounted on the camshaft 26 and of the second driven gear 51 mounted on the rotational shaft 37 are set to be different from each other.

Accordingly, the link mechanism 39 operates in association with the rotation of the eccentric shaft 38 with a speed reduction ratio of ½ according to the rotation of the crankshaft 17, in a manner that the stroke of the piston 18 in the expansion stroke becomes larger than that in the compression stroke. Thus, a higher expansion work is achieved with the same intake volume of the air-fuel mixture, so that the cycle thermal efficiency is improved.

Next, the operation of the first embodiment will be described. The driving gear 49 for transmitting the rotative power to the camshaft 26 side is mounted on the crankshaft 17, while the second driven gear 51 meshing with the driving gear 49 is mounted on the rotational shaft 37. The driving gear 49 is mounted on the crankshaft 17 so as to be shared for the power transmission from the crankshaft 17 to the camshaft 26 and for the power transmission from the crankshaft 17 to the rotational shaft 37. This configuration makes it possible to reduce the bearing span of the crankshaft 17 as compared with a conventional variable stroke engine having two driving gears mounted to be adjacent to each other on the crankshaft 17. Accordingly, the bearing support rigidity can be prevented from deteriorating while an increase in the diameter of the crankshaft 17 is avoided.

Moreover, since the addendum modifications respectively of the first driven gear 50 mounted on the camshaft 26 and of the second driven gear 51 mounted on the rotational shaft 37 are set to be different from each other, the load applied to the camshaft 26 and the rotational shaft 37 is optimally distributed. Accordingly, the engine can be reduced in size by individually setting the distance between the crankshaft 17 and the camshaft 26 as well as the distance between the crankshaft 17 and the rotational shaft 37.

Figure 3:
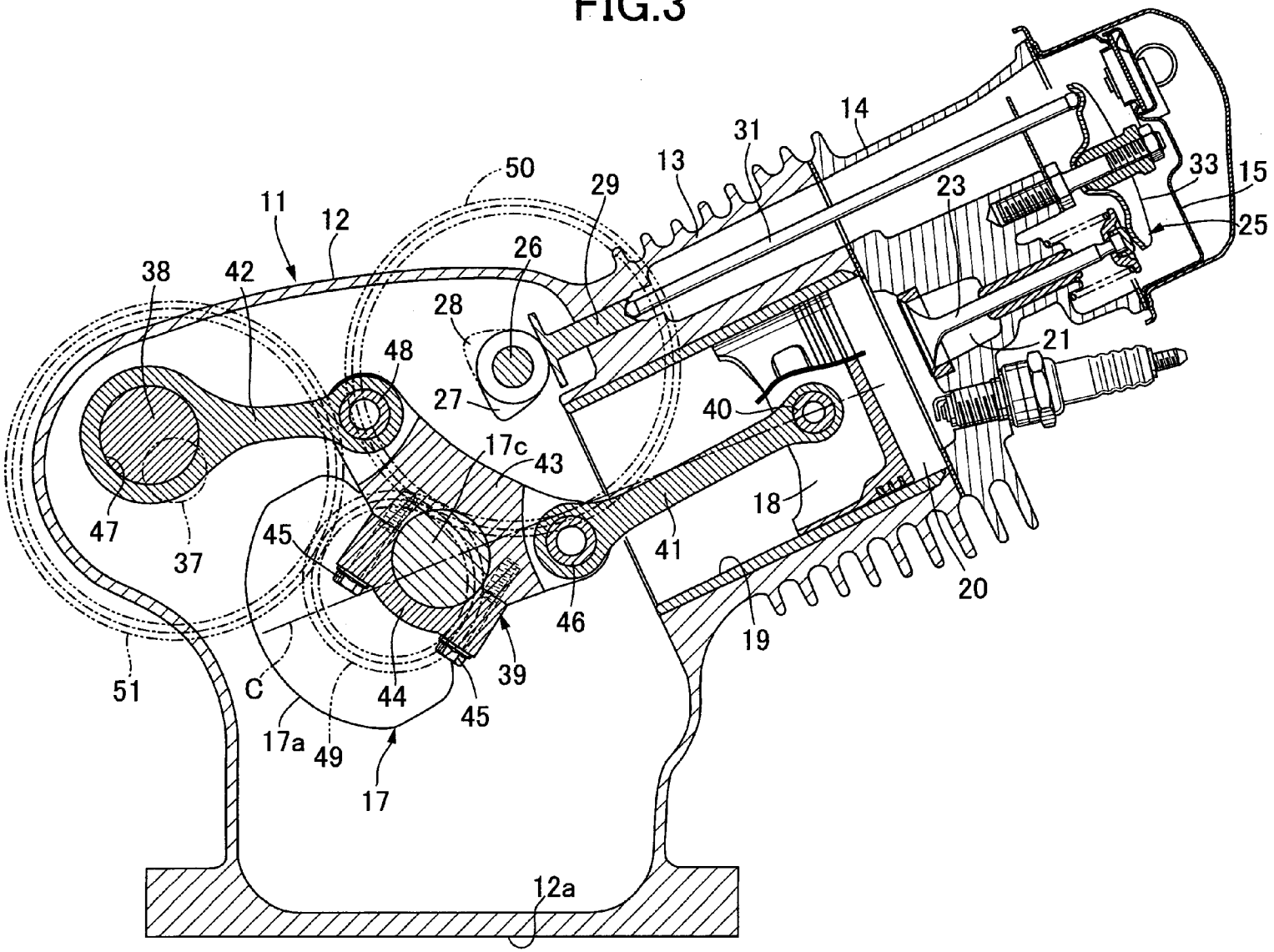
FIG. 3 is a vertical cross-sectional side view corresponding to FIG. 1, and showing an engine of a second embodiment.

FIG. 3 shows the second embodiment of the present invention. Parts corresponding to those in the first embodiment are shown in FIG. 3 with the same reference numerals, and are not described in detail.

In the first embodiment, the camshaft 26 is disposed on the opposite side of the axis of the crankshaft 17 from the rotational shaft 37. In the second embodiment, the camshaft 26 and a rotational shaft 37 are disposed on the same side of a plane defined by a cylinder axis C and the axis of the crankshaft 17. In conjunction with this structure, the intake-side valve lifter 29, the exhaust-side valve lifter 30, the intake-side push rod 31, and the exhaust-side push rod in the valve-operating system 25 are disposed on the opposite side from those in the first embodiment.

According to the second embodiment, it is possible to make the entire engine compact by disposing the camshaft 26 at a position close to the rotational shaft 37 side while avoiding interference between the camshaft 26 and the trajectory of the motion of the link member 43.

Although the embodiments of the present invention have been described so far, the present invention is not limited to those embodiments, and various modifications in design may be made without departing from the present invention described in the scope of claims.

For example, although the driving gear 49 is used as the timing driving wheel and the second driven gear 51 is used as the timing driven wheel in the above-described embodiments, the timing driving wheel and the timing driven wheel may be sprockets or toothed pulleys.

We claim:

1. A variable stroke engine, comprising:

a crankshaft;

a camshaft constituting a part of a valve-operating system;

a rotational shaft having an eccentric shaft, wherein said crankshaft, said camshaft and said rotational shaft are rotatably supported in a crankcase of an engine body so as to have axes parallel to one another;

a connecting rod connected, at one end portion thereof, to a piston by a piston pin;

a control rod connected, at one end portion thereof, to said eccentric shaft;

a second end portion of said connecting rod and a second end portion of said control rod being linked to each other by a link member, rotatably supported on said crankshaft, wherein a rotative power of said crankshaft is transmitted to said camshaft and said rotational shaft, respectively, wherein one driving gear is mounted on said crankshaft, and is used in common for transmitting rotative power to said camshaft side as well as for transmitting rotative power to said rotational shaft side, a first driven gear, which has a larger diameter than said driving gear and meshes with said driving gear, is mounted on said camshaft, a second driven gear, which has a larger diameter than said driving gear and meshes with said driving gear, is mounted on said rotational shaft, addendum modifications of said first and second driven gears are set to be different from one another, said camshaft and said rotational shaft are disposed on a same side of a plane defined by a cylinder axis and an axis of said crankshaft a minimum space between outer peripheries of the first and second driven gears is smaller than a radius of the driving gear.

* * * * *